US006792841B2

(12) United States Patent
Bucks

(10) Patent No.: US 6,792,841 B2
(45) Date of Patent: Sep. 21, 2004

(54) TRANSVERSE FOOD PRODUCT SLICER WITH INCLINED SHEAR EDGE SUPPORT SURFACE ENABLING PRODUCTION OF UNIFORM THICKNESS SLICES

(75) Inventor: Brent L. Bucks, Valparaiso, IN (US)

(73) Assignee: Urschel Laboratories Incorporated, Valparaiso, IN (US)

( * ) Notice: Subject to any disclaimer, the term of this patent is extended or adjusted under 35 U.S.C. 154(b) by 107 days.

(21) Appl. No.: 09/730,748

(22) Filed: Dec. 7, 2000

(65) Prior Publication Data

US 2001/0029818 A1 Oct. 18, 2001

Related U.S. Application Data

(60) Provisional application No. 60/169,621, filed on Dec. 8, 1999.

(51) Int. Cl.[7] ..... B26D 7/06
(52) U.S. Cl. ..... 83/418; 83/932
(58) Field of Search ..... 83/932, 356.3, 83/409, 418

(56) References Cited

U.S. PATENT DOCUMENTS

| | | | | |
|---|---|---|---|---|
| 2,482,523 | A | 9/1949 | Urschel et al. | 83/356.3 |
| 2,665,723 | A | 1/1954 | Urschel et al. | 241/89.4 |
| 3,004,572 | A | 10/1961 | Urschel et al. | 83/356.3 |
| 3,139,128 | A | 6/1964 | Urschel et al. | 83/111 |
| 3,139,129 | A | 6/1964 | Urschel et al. | 83/13 |
| 4,271,740 | A | 6/1981 | Yamazaki et al. | 83/392 |
| 4,813,317 | A | 3/1989 | Urschel et al. | 83/356.3 |
| 5,191,819 | A | 3/1993 | Hoshi | 83/349 |
| 5,501,127 | A | 3/1996 | Stauber | 83/100 |
| 5,992,284 | A | 11/1999 | Bucks | 83/663 |
| 6,148,702 | A | 11/2000 | Bucks | 83/13 |
| 6,148,709 | A | 11/2000 | Bucks | 83/663 |

*Primary Examiner*—Charles Goodman
(74) *Attorney, Agent, or Firm*—Bacon & Thomas, PLLC

(57) ABSTRACT

A transverse food slicer includes a generally horizontal conveyor for advancing food products to be sliced to a vertical cutting wheel having radially mounted cutting blades thereon rotating in a cutting plane that transversely slice the conveyed food products. Between the end of the conveyor and the cutting plane, an inclined support surface is provided to stabilize relatively round food products advanced to the cutting plane by the conveyor. The inclined support surface may cooperate with cutting blades having thickness determining gauging surfaces thereon facing towards the conveyor.

13 Claims, 5 Drawing Sheets

TRANSVERSE FOOD PRODUCT SLICER WITH INCLINED SHEAR EDGE SUPPORT SURFACE ENABLING PRODUCTION OF UNIFORM THICKNESS SLICES

This application claims the benefit of Provisional Application No. 60/169,621 filed Dec. 8, 1999.

FIELD OF THE INVENTION

This invention relates to transverse slicers for food products.

DISCUSSION OF RELATED ART

Transverse food slicers are described in the prior art as exemplified by U.S. Pat. No. 2,482,523 granted Sep. 20, 1949 and U.S. Pat. No. 3,004,572 granted Oct. 17, 1961. This type of slicing equipment includes a conveyor for advancing food products to be sliced along a generally horizontal direction so they traverse a cutting plane defined by the motion of radially extending cutting blades carried by a rotating cutting wheel that is mounted generally perpendicular to and transversely of the food product advancing direction. The rotating cutting blades transversely slice food products advanced through the cutting plane in a rapid manner to enable high volume production of food product slices by the food processors.

Recent refinements to the radial cutting blades of such slicers have enabled production of precise, thin, uniform thickness slices of various food products such as potatoes. Where potatoes are concerned, uniform thickness slices are required to enable high quality production of fried potato chips from the potato slices. Non-uniform potato slices, of course, inherently will result in non-uniform frying of the potato slices and poor quality potato chips. Other food processors demand precise, uniform thickness food product slices as well.

Transverse slicers of the type described above are capable of producing uniformly thick slices of potatoes that are elongate, but it has been observed that the use of such a transverse slicer to slice relatively round potatoes does not produce uniformly thick slices due to the motion of the round potato product as it leaves the conveyor and traverses the cutting plane of the transverse cutting wheel slicer. Relative motion between the potato product and the cutting blades results in a somewhat tapered slice that is undesirable for the purpose of producing uniformly fried potato chips. Processing of other food products also demands production of uniformly thick slices that do not vary substantially from slice to slice.

SUMMARY OF THE INVENTION

The present invention overcomes the problem of non-uniform thickness slices produced from relatively round food products such as potatoes advanced by a conveyor towards a cutting plane of a transverse cutting wheel.

The present invention comprises an apron or shear edge member located at the terminus area of a conveyor between such terminus and a cutting plane of a transverse cutting wheel and wherein the apron member has an upper food product supporting surface that supports and guides the food product between the conveyor and the cutting plane of the cutting wheel. The upper surface defines a shear edge at its end adjacent the cutting plane.

More specifically, the upper supporting surface of the apron member is downwardly sloped at an angle of from 30–70°, and preferably 45°, between the terminus of the conveyor and the cutting plane of the transverse cutting wheel to thereby improve the stability of the food product as it transitions from the conveyor to the cutting plane of the cutting wheel. The downwardly sloping upper surface of the apron member enables the food product to cooperate with the terminal end of the conveyor and the moving cutting knife blades in a manner that produces precise, uniformly thick slices of the food product by preventing relative movement between the food product and the cutting knife blades as the product traverses the space between the terminal end of the conveyor and the cutting plane of the cutting wheel.

The invention has particular advantages in connection with a cutting wheel using cutting blades that provide a gauging surface on the sides thereof facing the advancing food products and which are effectively pitched to advance the food product through the cutting wheel in rapid succession.

In accordance with the invention, an apron member is provided for supporting food products moving in a principal conveying direction towards a transverse cutting wheel having radial knife blades rotating in a cutting plane, wherein the apron member includes an upper product supporting surface inclined between 30–70°, and preferably 45°, generally along and downwardly relative to the principal conveying direction. The apron member terminates at a shear edge adjacent the cutting plane and substantially spans the distance between the terminus of a conveyor and the cutting plane of a transverse cutting wheel.

The apron member is usable in combination with a cutting wheel having knife blades thereon defining gate openings between the knife blades that determine the thickness of sliced food products engaging the knife blades as they are advanced to the cutting plane by the conveyor.

The invention is described in more detail below in conjunction with the appended drawings.

DETAILED DESCRIPTION OF THE DRAWINGS

With reference to the appended drawings.

Figure 7:
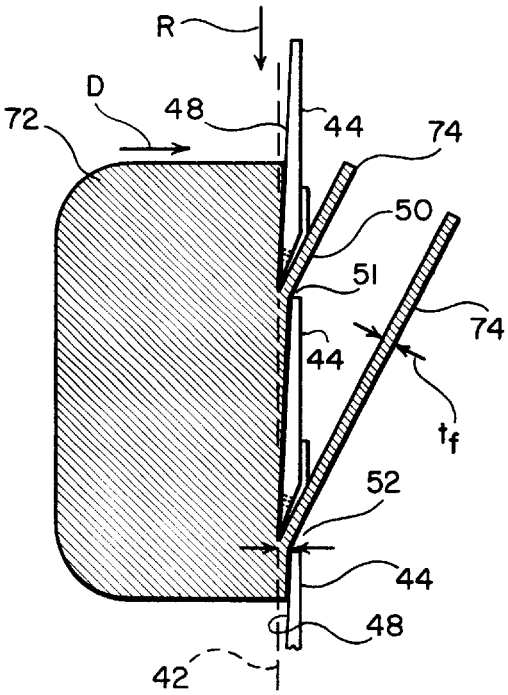
Figure 8:
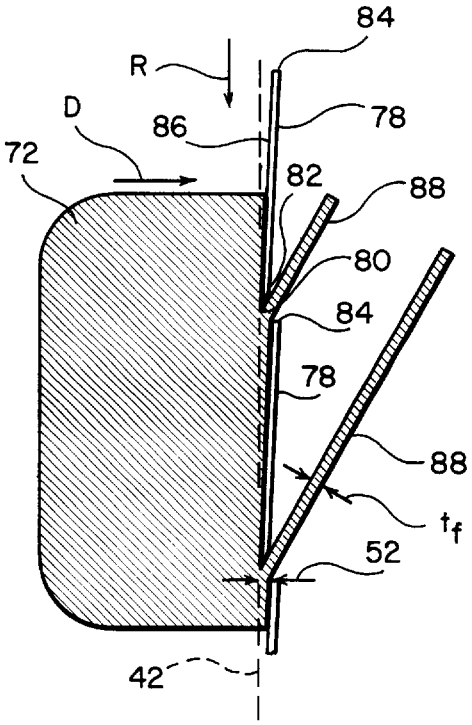
Figure 9:
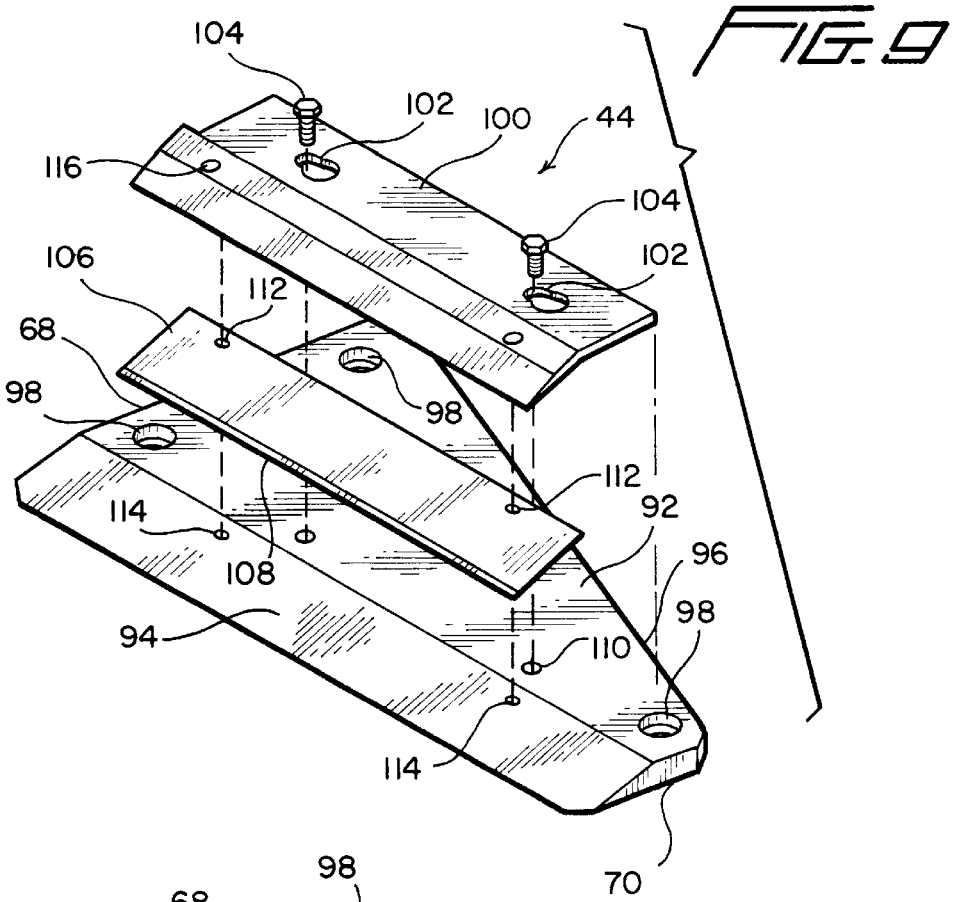
Figure 10:
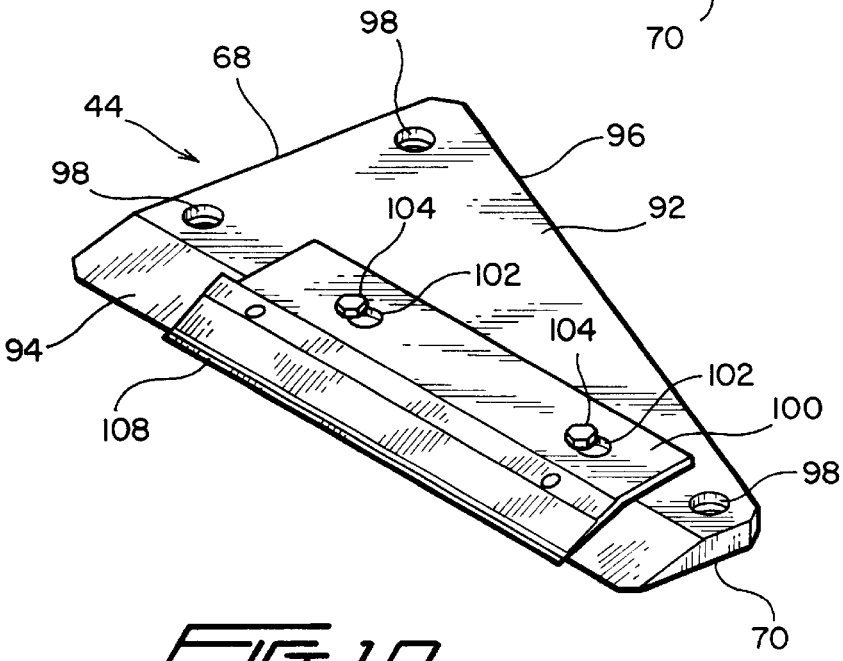
Figure 11:
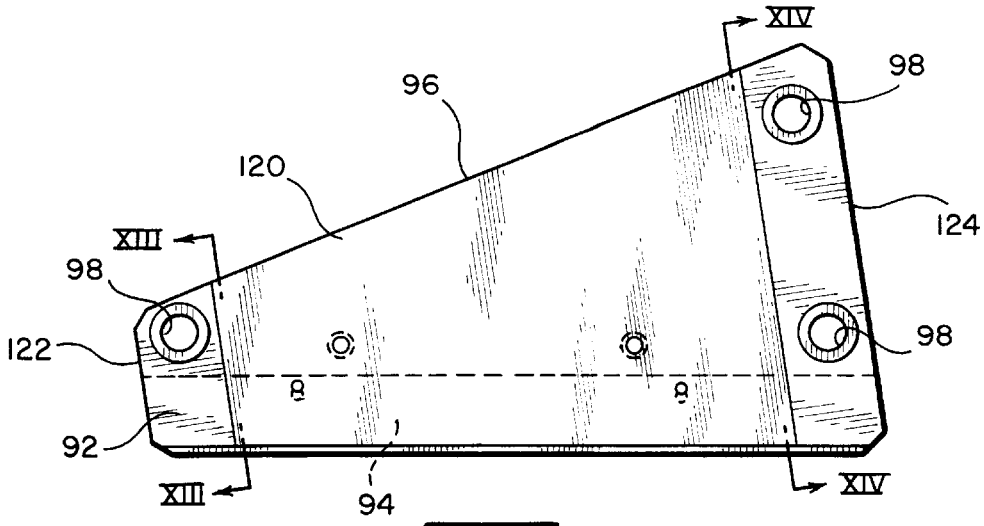
Figure 12:
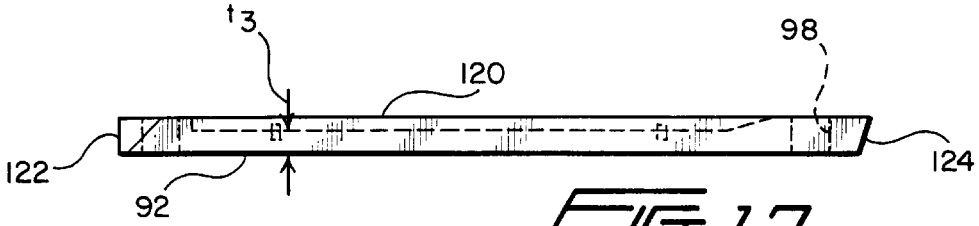
Figure 13:
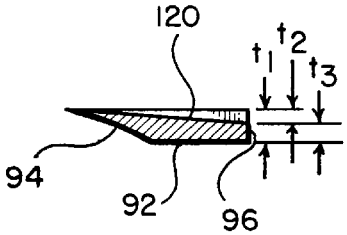
Figure 14:
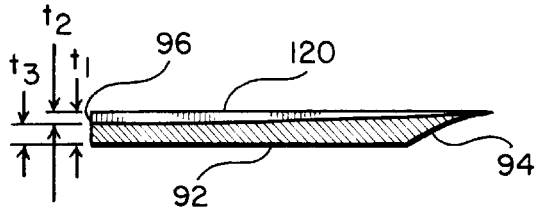

FIGS. 7 and 8 schematically illustrate precise slicing of food products using cutting wheel blades preferred for use with the apron member made in accordance with the invention;

FIGS. 9 and 10 respectively show perspective views of a disassembled and assembled cutting knife blade comprising a holder and a cutting blade element preferred for use with the apron member made in accordance with the invention;

FIGS. 11 and 12 respectively show a top plan and front view of a blade holder for use with the apron member made according to the invention; and FIGS. 13 and 14 respectively are section views taken along lines XIII—XIII and XIV—XIV in FIG. 11.

DETAILED DESCRIPTION OF PREFERRED EMBODIMENTS OF THE INVENTION

Figure 1:
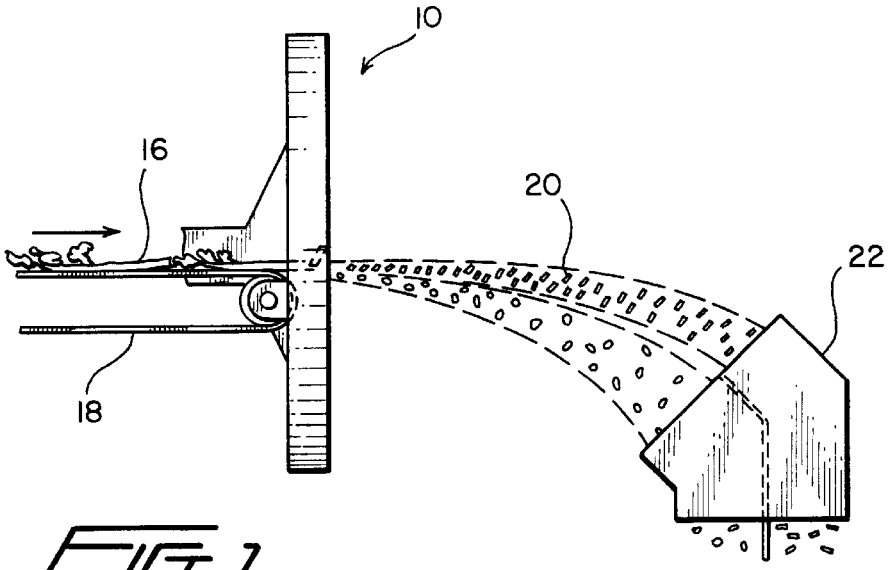
FIG. 1 (PRIOR ART)
FIG. 1 is a side elevation view of a prior art transverse slicer arrangement for slicing food products delivered to a transverse cutting wheel by a conveyor.
Figure 2:
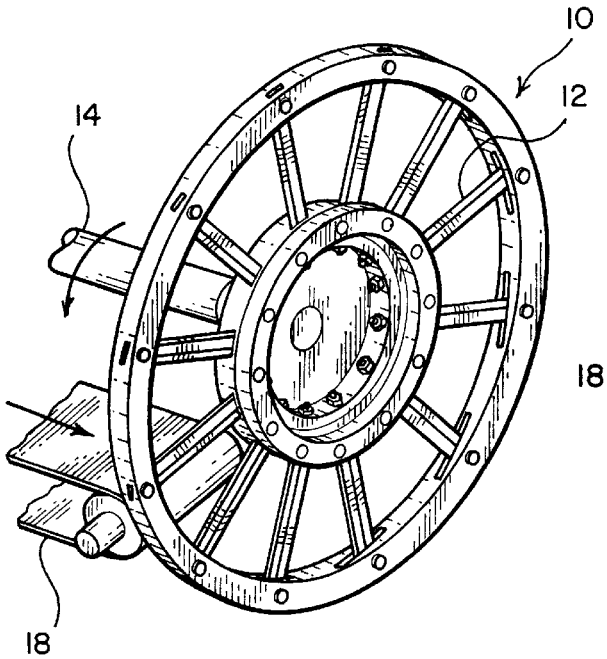
FIG. 2 (PRIOR ART)
FIG. 2 is a perspective view of the prior art cutting wheel shown in FIG. 1.

With reference to the appended drawings, FIG. 1 schematically depicts a transverse cutting wheel of a food product slicing machine constructed in accordance with the prior art, for example U.S. Pat. No. 2,482,523 granted Sep. 20, 1949. In accordance with this food product slicing arrangement, a generally vertical transverse cutting wheel 10 carrying radial cutting knife blades 12, as shown in FIG. 2, is driven in rotation via drive shaft 14 by a power input device (not illustrated). Each cutting knife blade 12 has a sharpened leading edge facing the direction of rotation of the cutting wheel 10. Food products 16 are conveyed by a conveyor device 18 in a generally horizontal direction towards the cutting wheel 10 and the food products are sliced by the cutting knife blades 12 as they advance through a cutting plane defined by the plane of rotation (cutting plane) of the knife blades 12. The sliced elements 20 may be deposited in an appropriate receptacle (not shown) and, if desired, may be separated by a separator 22 between heavier and lighter constituents en route to the receptacle.

Figure 3:
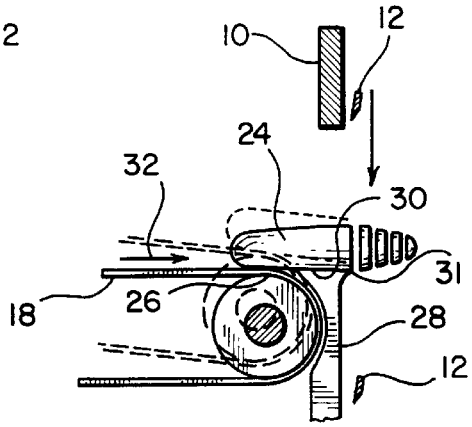
FIG. 3 (PRIOR ART)
FIG. 3 is a side elevational view schematically illustrating the cutting of elongated food products using the cutting wheel arrangement of FIG. 1.

The slicing process in accordance with this example is illustrated in FIG. 3, where an elongated food product 24 is advanced to the cutting plane of the vertical cutting wheel 10 by conveyor 18 and is sliced into uniform transverse slices by cutting blades 12 which, due to their pitch and velocity, propel the sliced products in the same direction as the conveying direction of the unsliced food products. For a fuller description of this prior art food slicing apparatus and process, reference may be made to U.S. Pat. No. 2,482,523.

As shown in FIG. 3, the unsliced food products 24 are individually supported in the zone between the terminus 26 of the conveyor 18 (the zone of the conveyor where the food product separates from the conveyor) and the cutting plane defined by the rotating blades 12 by an apron member 28 that has a supporting surface 30 at its upper end that terminates at a shear edge 31 and that supports the unsliced food product 24 in the area spanning the terminus 26 of the conveyor 18 and the cutting plane of the blades 12. In accordance with the prior art, the apron supporting surface 30 is oriented so that it is essentially parallel with the principal conveying direction 32 of the conveyor 18, such principal conveying direction determining the direction of advancement of the unsliced food product 24.

As depicted by the hidden lines in FIG. 3, the conveyor 18 and the principal conveying direction 32 may be inclined relative to a horizontal so that the unsliced food products 24 may enter the cutting plane essentially perpendicular to the pitched knife blades.

This overall arrangement has been successfully used by the food processing industry to reduce the size of food products, for example food products to be sliced, diced, cubed and shredded.

Producing precisely uniform thin slices of elongated or essentially round food products has been carried out in the food processing industry by using slicing equipment that provides a gate or gauging function for determining precise thickness of food product slices, such as fresh potatoes. Precision of slicing thickness is required when the slices are potatoes to be used to produce fried potato chips to ensure that the chips will be uniformly fried throughout their entire volume. A food product slicing machine usable in connection with such precise slicing is described in U.S. Pat. No. 3,139,129 granted Jun. 30, 1964. Such food slicing equipment generally is arranged to feed potatoes downwardly onto a horizontal rotating surface that centrifugally impels individual potatoes outwardly against a cutting blade that cooperates with a gauging surface to produce uniform, thin slices usable for making potato chips. Vertical transverse slicers of the type described above with reference to FIGS. 1–3 were not typically used to produce precise, thin uniform potato slices usable for potato chips, for example, due to their inability to provide a gauging surface against which the food product may be moved during the slicing procedure. Recent improvements made by the assignee of the present invention, however, have enabled transverse slicing of food products into precise, uniform slices using a transverse cutting wheel that is oriented essentially vertically relative to a horizontal conveyor.

The innovative cutting wheel and cutting knife blade arrangement used to provide a gauging surface in such apparatus is described below in connection with FIGS. 6–14. While the improved cutting wheel arrangement is effective in producing uniform thin slices of elongate food products such as elongate potatoes, it has been observed that precise, uniform thin slices using such apparatus are not always obtained when round food products are advanced to the cutting wheel by a conveyor due to the dynamics that exist between the food product, the conveyor the shear edge support and the rotating cutting knife blades. Essentially, the food product is not stable as it approaches the terminus of the conveyor so that the gauging effect provided by the rotating cutting knife blades is not fully achieved when slicing such relatively round food products.

With experimentation, it was discovered that the problem of precisely and uniformly slicing round food products using a transverse slicer of the type depicted in FIGS. 1–3 and using rotating knife blades that provide a gate or gauging effect could be achieved if the upper surface of the apron or shear edge supporting member located between the terminus of the conveyor and the cutting plane of the cutting wheel was sloped downwardly at an angle of between 30–70°, and preferably about 45°, relative to the principal conveying direction of the conveyor. That is, the upper surface is inclined at an angle of preferably about 45°, but within a range of about 30–70°, downwardly along the principal conveying direction between the end area of the conveyor and the cutting plane of the cutting wheel. For optimum performance, the angle of the upper surface 36 will be tangent to the curvature of the conveyor as it traverses the conveyor pulley 33 at the terminus of the conveyor 38, preferably slightly below the tangent point. This results in a smooth transition of the food products conveyed on the conveying surface 39 of conveyor 38 to the surface 36.

Figure 4:
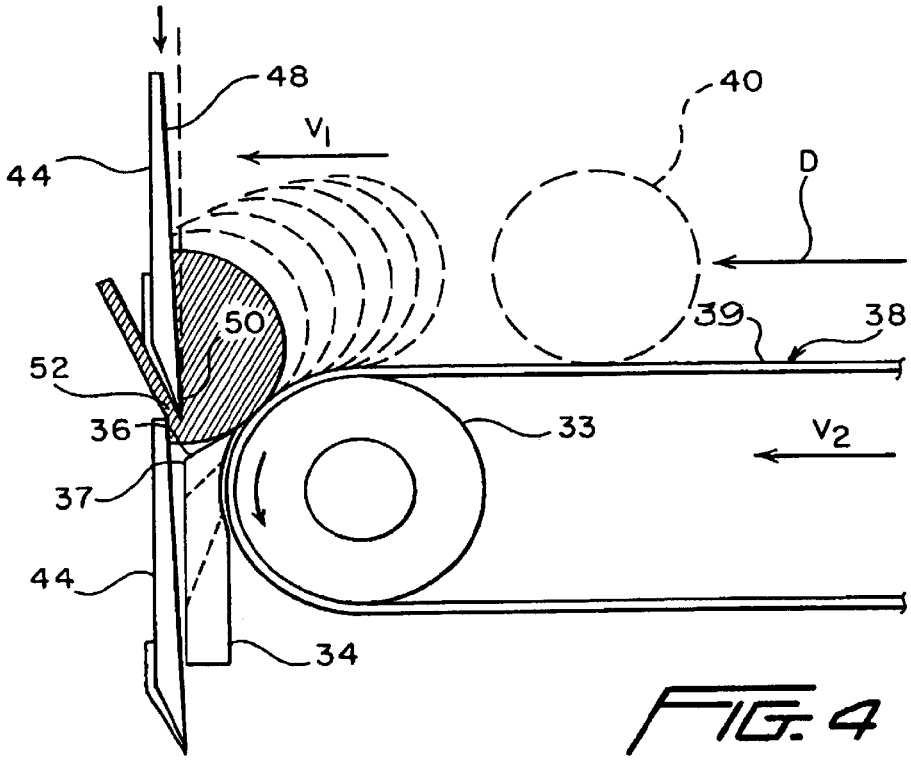
FIG. 4 is a side elevation view showing the food product supporting apron member according to the invention used with a transverse cutting wheel and a food product conveyor.

This arrangement of an apron member 34 including an upper supporting surface 36 terminating at shear edge 37 is shown in FIG. 4 where the apron member 34 is located at the terminus area of a conveyor 38 having an upper surface 39 that advances or conveys a food product 40 along a principal conveying direction that is essentially perpendicular to a cutting plane 42 in which radial knife blades 44 are moved when a cutting wheel (not illustrated) carrying the radial blades 44 is driven in rotation. The cutting plane 42 thus extends essentially transversely of the principal conveying direction D of the food products 40. The member 34 may be supported at the illustrated location by any conventional support system.

The pitch, configuration and velocity of the blades 44 propel the food products 40 through the cutting plane 42 at a velocity $V_1$ while the conveyor 38 advances the food products 40 towards the cutting plane 42 at a velocity $V_2$. The relationship between $V_1$ and $V_2$ will be discussed below.

The blades 44 include gauging surfaces 48 that cooperate with the sharpened leading edges 50 of the cutting knife blades so as to define a slice thickness gap or gate 52 between the leading cutting edge 50 of a blade 44 and a trailing gauge surface 48 of an adjacent leading blade 44.

With such an arrangement, it has been found desirable to advance the food product 40 to the cutting plane 42 by conveying the food product at a velocity $V_2$ that is a multiple of approximately 1.8 times the velocity $V_1$ at which the food product is advanced through the cutting plane 42 by the propelling action of the cutting knife blades 44.

The downwardly sloping upper support surface 36 of apron member 34 enables gravity to assist in moving the food product 40 towards the cutting blades 44 and to maintain engagement between the food products 40 and the gauging surfaces 48 of the blades 44 as the food products leave the conveyor 38. The conveyor 38, of course, at least partially supports the food products 40 as they are advanced towards the cutting plane 42 and the food product 40 is initially supported by the terminal end of the conveyor 38 and then progressively is supported by the supporting surface 36 of the apron member 34 while the food product moves downwardly towards the shear edge 37 around the terminal end of the conveyor 38, which in the illustrated example is constituted of an endless belt traversing a pulley at its terminal end adjacent the cutting plane 42, in accordance with a well-known organization of conveyor and cutting wheel.

Figure 5:
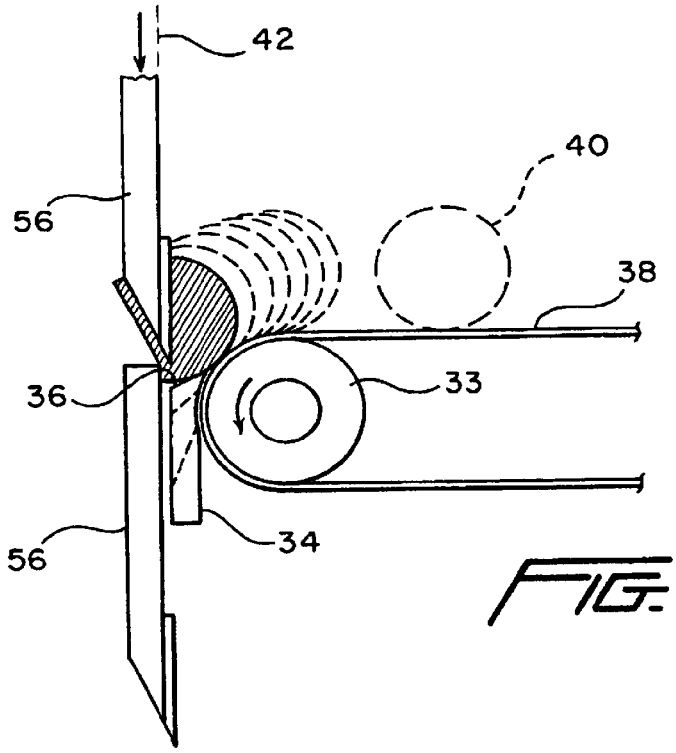
FIG. 5 is similar to FIG. 4 but shows the use of a different cutting wheel with the apron member.

In accordance with a different embodiment of the invention, cutting blades 56 without specifically defined gauging surfaces may be utilized with an apron member made in accordance with the invention having a downwardly sloping upper surface 36, as shown in FIG. 5. Thus, the use of an apron member 34 having a downwardly sloping upper food product supporting surface 36 is not limited in use to a food slicing apparatus using a cutting knife blade of the type illustrated in FIG. 4.

It will be noted that the advancement of the food products 40 in either embodiment is stabilized somewhat by the frictional contact between the food products and the surface of the conveyor 38 as the food products reach the terminus of the conveyor and begin moving over the end of the conveyor as they approach the cutting plane 42 of the blades 44,56. As noted above, it is believed that this effect of the conveyor surface on the food products is optimized when the ratio of food product velocity $V_2$ from transportation of the food products 40 by the conveyor 38 in the principal conveying direction D is a multiple of approximately 1.8 times the velocity V, of the food products induced by the propelling action of the rotating cutting knife blades 44.

Figure 6:
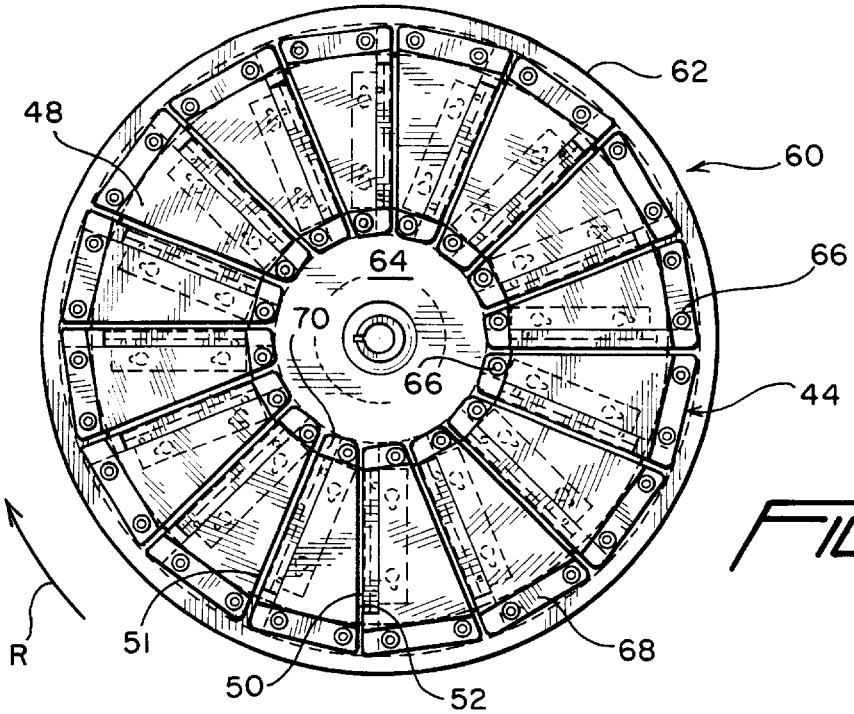
FIG. 6 is a front elevation view of a preferred cutting wheel arrangement usable with the apron member made in accordance with the invention.

An arrangement of a cutting wheel and radially extending cutting knife blades useful for carrying out the slicing process depicted in FIG. 4 is illustrated in FIG. 6, wherein a cutting wheel 60 including a rim portion 62 and a hub portion 64 supports truncated triangular shaped cutting knife blades 44 by means of fasteners 66 so that the blades span the distance between the hub portion 64 and the rim portion 62 of the cutting wheel 60.

The cutting blades 44 in accordance with this embodiment comprise cutting blade holders that support individual cutting blade elements to be described below in connection with FIGS. 9 and 10. As viewed in FIG. 6, gauging surfaces 48 facing towards approaching food products to be sliced by the cutting wheel 60 are formed in a manner to be described below to ensure the formation of a uniform slice thickness defining gate or gap 52 located between the leading edges 50 of the cutting knife blades 44 and the trailing edges 51 of the next leading cutting knife blade adjacent the leading edge 52.

In accordance with known technology, the blades 44 may be tensioned between the hub portion 64 and the rim portion 62 of the wheel 60 and it will be noted that the blades 44 essentially fill the area between the hub portion 64 and the rim portion 62 due to the truncated triangular configuration of the cutting knife blades 44. In accordance with this embodiment, the wider ends 68 of the blades 44 are connected to the rim portion 62 while the narrower ends 70 are fastened to the rim portion 64.

As shown in FIG. 7, food products 72 conveyed to the cutting plane 42 in which the blades 44 are moving when cutting wheel 60 is driven in rotation in direction R engage the gauging surfaces 48 of blades 44 and are sliced in precise, uniform thickness slices 74 as the blades 44 traverse the food product with the leading edges 50 of the blades 44 creating uniform slices having thickness $t_f$ corresponding to the gate 52 between the blade leading edges 50 and the trailing ends 51 of the next adjacent blade 44 in the leading direction.

As described previously, the apron element 44 with the downwardly sloping upper supporting surface 36 is intended to enhance the operation of a cutting wheel 60 having cutting blades 44 with gauging surfaces 48 thereon by maintaining the food products 40,72 in close engagement with the gauging surfaces 48 as the food product traverses the terminus of a conveyor and the cutting plane 42 of the blades 44.

The knife blades 44 will be described momentarily but it is to be understood that they may be constituted of an assembly of a knife blade holder and a knife blade element or, alternatively, a single piece cutting knife blade 78 as shown in FIG. 8. In the embodiment of FIG. 8, a single cutting knife blade 78 is mounted on a cutting wheel (not shown) so that the blade effectively is twisted from its inboard to its outboard end to produce a uniform slice thickness determining gate 80 between each blade leading edge 82 and the trailing edge 84 of the next leading adjacent blade 78. The gauging surface 86 on the side of the blades 78 facing the advancing food product 72 is configured to provide a uniform gate opening 80 to thereby produce precisely uniform thin slices 88 of the food product 72 as the blades 78 traverse the food product while it is advanced in the direction D towards the cutting plane 42 by a conveyor (not shown). The blade 78 is formed as a truncated triangular member similar to the cutting knife blade 44 shown in FIG. 6, and traverses the interval between a hub portion and a rim portion of a cutting wheel driven in rotation to advance the blades 78 in the direction R shown in FIG. 8. The leading edges 82 of the blades 78, of course, are sharpened in accordance with known technology, preferably in the form of a beveled edge. The pitch and rotational velocity of the blades 78 determine the velocity at which the food product 72 is propelled through the cutting plane 42, as described previously.

The cutting knife blades 44 configured as knife blade holders are shown in more detail in FIGS. 9–14. As shown in FIGS. 9 and 10, the cutting knife blades 44 each comprises a relatively rigid generally planar member 92 having a beveled leading edge 94 and a relatively blunt trailing edge 96. The planar member 92 includes fastener receiving apertures 98 through which appropriate fasteners may be received for securing the blades 44 to a cutting wheel in the manner described previously in connection with the cutting wheel shown in FIG. 6.

A cutting blade element retainer member 100 is provided, having fastener receiving apertures 102 through which fasteners 104 extend for assembling the retainer member 100 to the side of planar member 92 facing away from advancing food products approaching the cutting wheel.

A cutting blade element 106 having a sharpened leading edge 108 is mounted on the beveled surface 94 of the member 92 and secured at that position by the retainer 100 and the fasteners 104 which are received in threaded apertures 110 in member 92. Blade element 106 preferably includes apertures 112 that may be aligned with studs 114 to accurately locate each blade element 106 on member 92 and to prevent movement of the blade element 106 relative to the member 92 after the retainer 100 has been secured on the member 92 by fasteners 104, all as illustrated in FIG. 10. Retainer 100 may include bores 116 that engage stud 114*s* for alignment and securing purposes and also to accommodate the studs 114.

Each planar member 92 includes a gauging surface 120 (FIG. 11) on the side thereof facing the direction of advancing food products (i.e., towards the conveyor) when the cutting knife blade is mounted in a cutting wheel as shown in FIG. 6. The gauging surface 120 comprises a machined or formed surface that slopes progressively from the leading edge of the beveled surface 94 rearwardly towards the trailing edge 96 of the member 92. The member 92, as noted previously, includes a shorter end 122 and a wider end 124. In order to obtain a uniformly thick trailing edge 96 required to produce a uniform slice thickness determining gate corresponding to gap 52 illustrated in FIG. 6, the gauging surface 120 must be formed so that between the shorter and longer ends 122,124 of member 92, a gauging surface 120 is defined which progressively changes in slope from the shorter end towards the outer end to produce a uniform thickness trailing edge 96 in the gauging area 120 of the member 92.

This uniform thickness is illustrated at $t_3$ in FIGS. 12, 13 and 14. Obviously, since the distance between the beveled edge area 94 at the leading edge of the member 92 and the trailing edge 96 between the shorter and longer ends 122,124 of member 92 changes progressively from one end of the member 92 to the other, the slope of the gauging surface 120 must vary progressively from the shorter end to the longer end of the member 92 as depicted in FIGS. 13 and 14, which represent views taken along section lines XIII—XIII and XIV—XIV, respectively in FIG. 11. As shown in FIG. 13, the gauging surface 120 slopes inwardly towards the opposite surface of member 92 in a linear fashion to define a depth $t_2$ within the total thickness $t_1$ of the member 92 to produce a trailing edge 96 having thickness $t_3$. As shown in FIG. 14, at the wider end of the member 92, the gauging surface 120 slopes inwardly towards the opposite surface of the member 92 at a more gradual rate as compared with the surface 122 shown in FIG. 13 so that it produces the thickness $t_3$ at trailing edge 96 after traversing a depth $t_2$ through total thickness $t_1$ of member 92. Of course, sections taken through member 92 between sections XIII—XIII and XIV—XIV would show continuously varying slopes of gauging surface 120 that would be required to produce uniform thickness $t_3$ at the trailing edge 96 of the member 92.

When members 92 with cutting blade elements 106 mounted thereon are placed on a cutting wheel as shown in FIG. 6, uniform thickness defining gaps 52 as shown in FIG. 6 are produced without any need to twist or warp the members 92 between their radially inner and outer ends.

The blades 78 as shown in FIG. 8 are made of relatively flexible, thin knife blade material and may be twisted between their inner and outer ends in a uniform manner to produce gauging surfaces 86 that will result in precise uniform slices being produced when food products are advanced against gauging surfaces by a conveyor.

It will thus be seen that a downwardly sloping upper food product shear edge support surface 36 on an apron member 34 avoids the production of non-uniform or tapered slices obtained when transversely slicing relatively round food products that are advanced to the cutting plane of a transverse slicer using cutting knife blades having gauging surfaces against which the food products are advanced during slicing.

It will be understood that the preferred embodiments of the invention have been described herein in compliance with the patent statute and that changes can be made to the described embodiments without departing from the spirit and scope of the invention as defined in the claims that follow.

What is claimed:

1. An apron arrangement for supporting food products moving in a principal generally horizontal conveying direction towards a transverse cutting wheel having radial knife blades rotating in a cutting plane oriented substantially vertically, said apron member including an upper product supporting surface terminating at a shear edge and located between a cutting plane in which radial knife blades are movable by a transverse cutting wheel and a conveyor movable to convey food products in a principal conveying direction towards such cutting plane;

wherein said conveyor terminates at a terminus including a conveyor pulley having an upper area over which the conveyor is guided in an advancing conveying direction adjacent said cutting plane, said supporting surface substantially spanning the distance between said terminus and said cutting plane and located below the pulley upper area; said supporting surface inclined downwardly 30–70° relative to the principal conveying direction.

2. An apron arrangement as claimed in claim 1, said cutting wheel including a hub and a rim; each radial knife blade having a leading edge facing a direction of rotation of the wheel and extending generally radially from the hub to the rim, each knife blade having a gauging surface facing opposite said principal conveying direction, a cutting edge on the leading edge of the knife blade and a second edge on the trailing edge of the knife blade relative to the direction of wheel rotation forming a juncture with the gauging surface, the juncture extending substantially parallel to and spaced in the food product principal conveying direction from the cutting edge of the next adjacent knife located in a trailing direction so as to form a gate opening therebetween, the gate opening being substantially constant and determining a thickness of the sliced food product engaging the knife blades while the wheel is rotated to advance the knife blades in a cutting plane.

3. The apron member arrangement as claimed in claim 2 wherein the gauging surface of each knife blade extends between the cutting edge and the second edge of the respective knife blade.

4. The apron member arrangement as claimed in claim 2 wherein each knife blade is substantially triangular in configuration.

5. The apron arrangement as claimed in claim 2 wherein each knife blade is wider at its rim end than at its hub end.

6. The apron arrangement as claimed in claim 2 wherein each knife blade comprises:

a knife blade element holder having the second edge and the gauging surface thereon; and, a knife blade element attached to the knife blade holder, the knife blade element having a cutting edge thereon located at said leading edge.

7. The apron member arrangement as claimed in claim 6 further comprising a clamp member connected to the knife blade element holder so as to removably clamp the knife blade element onto the knife blade holder.

8. The apron member arrangement as claimed in claim 6 wherein the knife blade element holder is attached at its opposite ends to and extends between the hub and the rim, the width of the knife blade element holder at the hub end being less than the width of the knife holder at the rim end.

9. The apron member arrangement as claimed in claim 1, wherein said radial knife blades each comprises a knife blade element holder comprising:

a truncated triangular plate member having a shorter end and an opposed longer end;

a uniformly thin first or leading edge extending along one side of said plate member between said opposed ends and arranged to receive a sharpened knife blade element extendable along said leading edge;

a second or trailing edge located opposite said leading edge and extending between said opposed ends, said trailing edge diverging from said leading edge between said shorter end and said longer end;

a front surface extending between said leading and trailing edges;

an opposed rear gauging surface extending between said leading and trailing edges;

said gauging surface sloping inwardly towards said front surface between said leading and trailing edges so that the trailing edge has a uniform thickness between said front and rear surfaces between said opposed ends over the length of said gauging surfaces;

the thickness of the plate member decreasing between said front and rear surfaces between said opposed ends over the length of said gauging surface so as to result in said rearward edge having said uniform thickness.

10. The apron arrangement as claimed in claim 9, including a clamping device attachable to the front surface of the knife blade element holder and a securing device retaining the clamping member adjacent and along said leading edge on said front surface.

11. The apron member arrangement as claimed in claim 10, wherein the knife blade element has a sharpened leading edge retained between said plate member and said clamping device so that the leading edge of the blade element is disposed on said front surface in front of said leading edge of said plate member.

12. The apron arrangement as claimed in claim 1, wherein said angle is 45°.

13. The apron arrangement as claimed in claim 1, wherein said supporting surface extends in a position between tangentially and slightly below tangentially of the curvature of the conveyor where it passes over the upper area of the pulley.

* * * * *